US009381521B2

(12) United States Patent
Pirie et al.

(10) Patent No.: US 9,381,521 B2
(45) Date of Patent: Jul. 5, 2016

(54) HOT MAGNETIC SEPARATOR INCLUDING HEAT SHIELD

(71) Applicant: Outotec (Finland) Oy, Espoo (FI)

(72) Inventors: Michael Pirie, Jessup, MD (US); Javier Castro, Jessup, MD (US)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 14/489,942

(22) Filed: Sep. 18, 2014

(65) Prior Publication Data

US 2016/0082445 A1 Mar. 24, 2016

(51) Int. Cl.

| | |
|---|---|
| ***B03B 9/06*** | (2006.01) |
| ***B03C 1/30*** | (2006.01) |
| ***B03C 1/005*** | (2006.01) |

(52) U.S. Cl.

CPC .. *B03C 1/30* (2013.01); *B03C 1/005* (2013.01)

(58) Field of Classification Search

CPC ..... B03C 1/00; B03C 1/015; B03C 1/14
USPC ..... 209/3.2, 8, 11, 223.2, 231
See application file for complete search history.

(56) References Cited

U.S. PATENT DOCUMENTS

| | | | | |
|---|---|---|---|---|
| 3,327,852 A * | 6/1967 | Mortsell | B03C 1/14 209/219 |
| 3,856,666 A * | 12/1974 | Yashima | B03C 1/14 209/219 |
| 6,330,946 B1 * | 12/2001 | Allen | B03C 1/12 209/219 |
| 7,478,727 B2 * | 1/2009 | Grey | B03C 1/0332 209/223.2 |
| 8,544,281 B2 * | 10/2013 | Zhang | G01R 33/3804 62/45.1 |

* cited by examiner

*Primary Examiner* — Terrell Matthews
(74) *Attorney, Agent, or Firm* — Buchanan, Ingersoll & Rooney PC

(57) ABSTRACT

An apparatus for separating hot particles including a plurality of materials having different magnetic properties includes a plurality of permanent magnets arranged in a magnet assembly and configured to create a magnetic flux capable of providing a coercive force on at least a portion of the particles, a moving surface proximate the magnet assembly for carrying the particles in a downward path through the magnetic flux while the coercive force attracts the portion of the hot particles toward the moving surface, a feed system for supplying the particles onto the moving surface, and a cooling system for maintaining the temperature of the magnets substantially below their Curie point, the cooling system comprising a pair of plates which are disposed between the magnet assembly and the moving surface, the cooling system configured to operate by passing a contained cooling fluid through a gap between the pair of plates.

9 Claims, 5 Drawing Sheets

HOT MAGNETIC SEPARATOR INCLUDING HEAT SHIELD

TECHNOLOGICAL FIELD

The present invention relates generally to a magnetic separation apparatus and particularly to heat shielding of the magnet assembly.

BACKGROUND DISCUSSION

There is a significant need to magnetically separate materials at as high a temperature as feasible. The upper limit for the temperature of this magnetic process is the Curie point or Curie temperature of the magnetic components of the mixture, which is the point where certain magnetic materials undergo a sharp change in the magnetic properties of the material. In particular, certain hot magnetic separation processes need to manage feed temperatures of up to about 700 to 800 degrees C.

A hot magnetic separator apparatus is disclosed in U.S. Pat. No. 7,478,727, the entire content of which is incorporated by reference herein. In the hot magnetic separator apparatus of U.S. Pat. No. 7,478,727, a cooling tube circuit for cooling fluid is disposed between a magnet assembly and a moving surface. However, a need exists for a more efficient, cost-effective configuration for routing of the cooling fluid which can be scaled to larger sized separators while keeping the required input pressure within acceptable levels and allowing the moving surface to remain sufficiently close to the magnet assembly.

SUMMARY

The disclosure here involves an apparatus for separating hot particles including a plurality of materials having different magnetic properties. The apparatus includes a plurality of permanent magnets arranged in a magnet assembly and configured to create a magnetic flux capable of providing a coercive force on at least a portion of the particles, a moving surface proximate the magnet assembly for carrying the particles in a downward path through the magnetic flux while the coercive force attracts the portion of the hot particles toward the moving surface, a feed system for supplying the particles onto the moving surface, and a cooling system for maintaining the temperature of the magnets substantially below their Curie point, the cooling system comprising a pair of plates which are disposed between the magnet assembly and the moving surface, the cooling system configured to operate by passing a contained cooling fluid through a gap between the pair of plates.

In an embodiment, at least one barrier is provided within the gap to lengthen a coolant flow path defined within the gap.

In an embodiment, the cooling system further comprises a second pair of plates defining a second gap in serial fluid communication with the gap defined by the pair of plates.

In an embodiment, the apparatus further includes a supply of inert cooling gas and a conduit for supplying the gas into the magnet assembly for purging the magnet assembly of oxygen.

In an embodiment, a housing has an interior space defining a processing zone which includes the moving surface, the magnet assembly, the feed system, and the cooling system, the housing enclosing the processing zone for maintaining the processing zone at an elevated temperature and substantially filled with the inert gas.

In an embodiment, the cooling system maintains the temperature of the magnets below 120 degrees C.

In an embodiment, a control system controls the temperature of the particles supplied by the feed system.

In an embodiment, the control system controls the feed system based on one or more monitored temperatures of the apparatus.

In an embodiment, a splitter below the moving surface selectively divides particles of less magnetic strength from those of greater magnetic strength.

In an embodiment, the moving surface moves in a curved path.

BRIEF DESCRIPTION OF THE DRAWING FIGURES

Additional features and aspects of the hot magnetic separator disclosed here will become more apparent from the following detailed description considered with reference to the accompanying drawing figures in which like elements are designated by like reference numerals.

DETAILED DESCRIPTION

Figure 1:
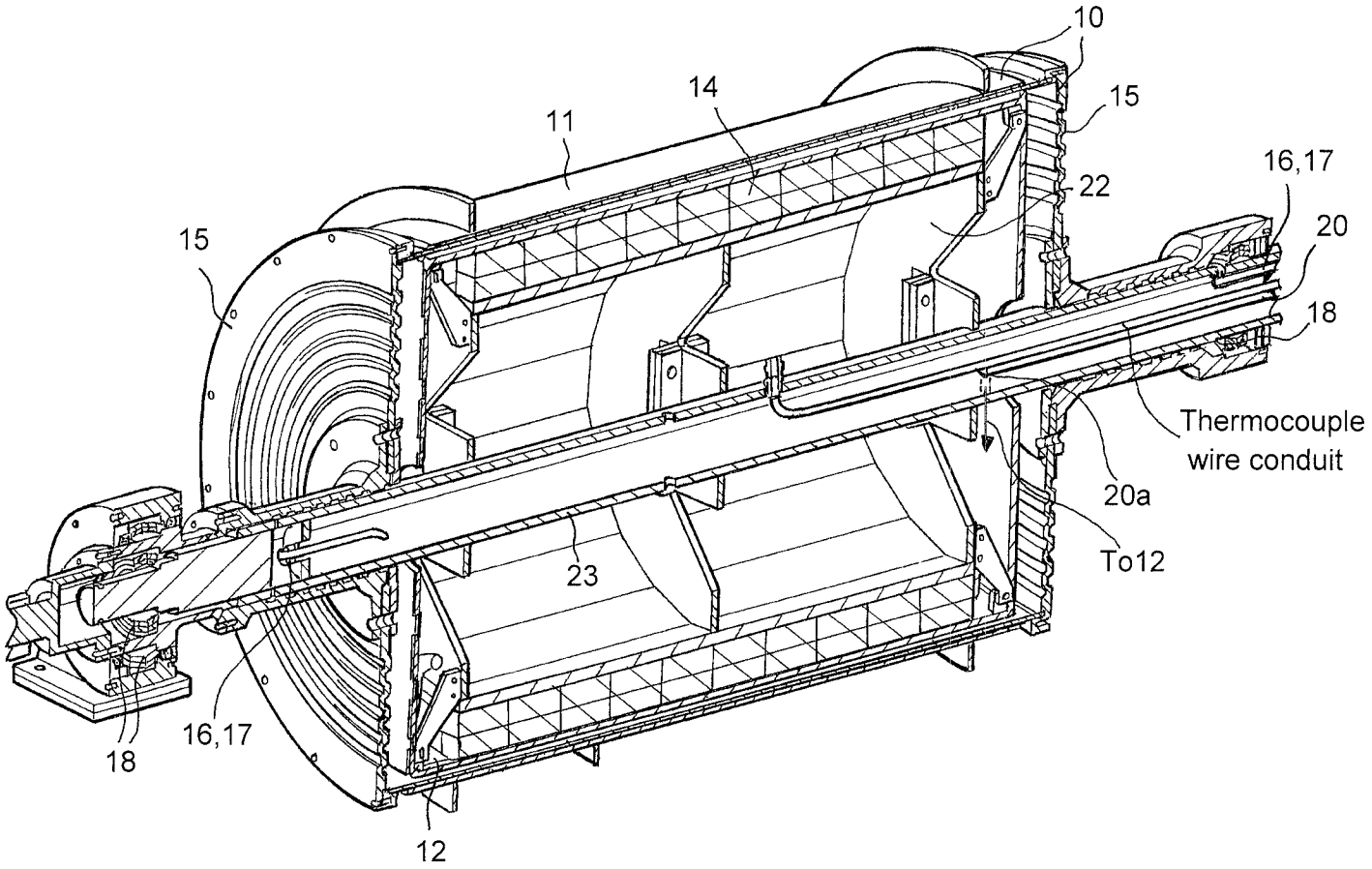
FIG. 1 is a pictorial view of a cooling apparatus used in an embodiment of a hot magnetic separator.
Figure 2:
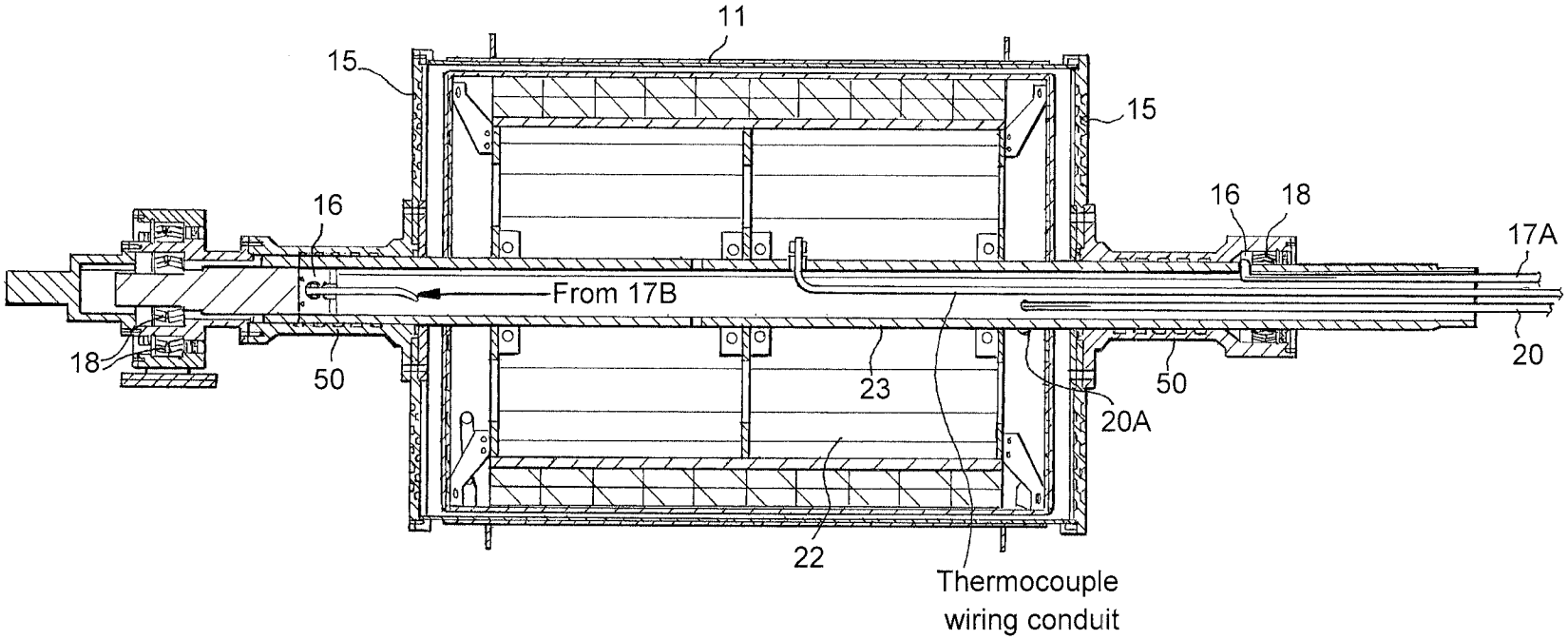
FIG. 2 is a partial cross-sectional view of the hollow shaft and drum assembly in the embodiment.

An embodiment of the apparatus for separating hot particles including a plurality of materials having different magnetic properties is illustrated in FIGS. 1-5. As illustrated in FIGS. 1 and 2, the apparatus includes a plurality of permanent magnets 14 arranged in a magnet assembly 22. The magnets 14 create a magnetic flux capable of providing a coercive force on at least a portion of the hot particles fed into the apparatus.

The apparatus also includes a moving surface/shell 11 proximate the magnet assembly 22. A pair of end plates 15 are joined to the respective opposite side openings of the shell 11. The shell 11 and end plates 15 together form a drum 10 and are either in contact with the high temperature feed material or are very near it. These parts must be designed and made to withstand the high temperatures, abrasive nature, and significant thermal expansion that are caused by a temperature change of up to 700 to 800 degrees C. To combat this, high nickel super-alloys, commonly known in the industry, are the chosen materials for the shell 11 and end plates 15.

Figure 3:
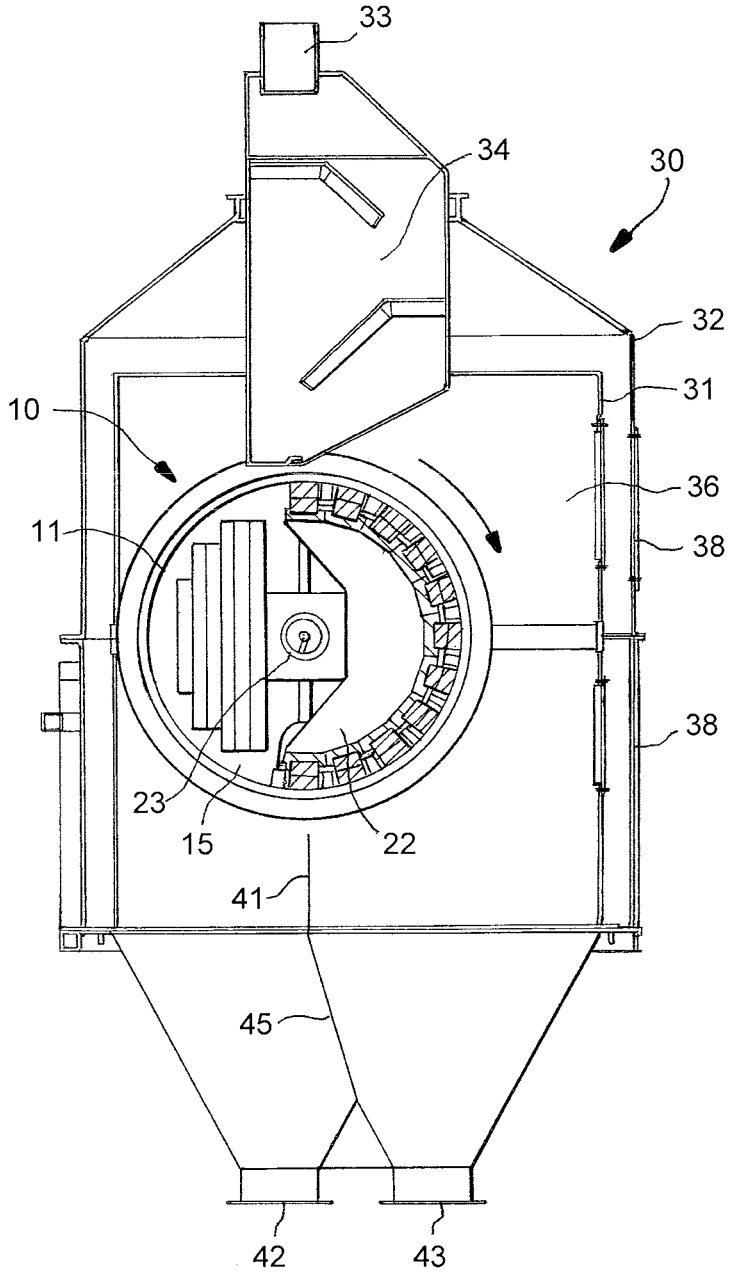
FIG. 3 is a cross-sectional view across the hot magnetic separator of the embodiment.

As illustrated in FIG. 3, the shell 11 is cylindrical and carries the particles in a downward path through the magnetic flux while the coercive force attracts the portion of the hot particles toward the shell 11. And as illustrated in FIG. 1, the end plates 15 are mounted on bearings 18 disposed between the end plates 15 and a stationary shaft 23. Thus, in the embodiment, the shell 11 rotates (i.e., moves in a curved path) to thereby carry the particles in the downward path. The drum 10 is driven to rotate by motor-driven driveshaft 50.

Figure 4:
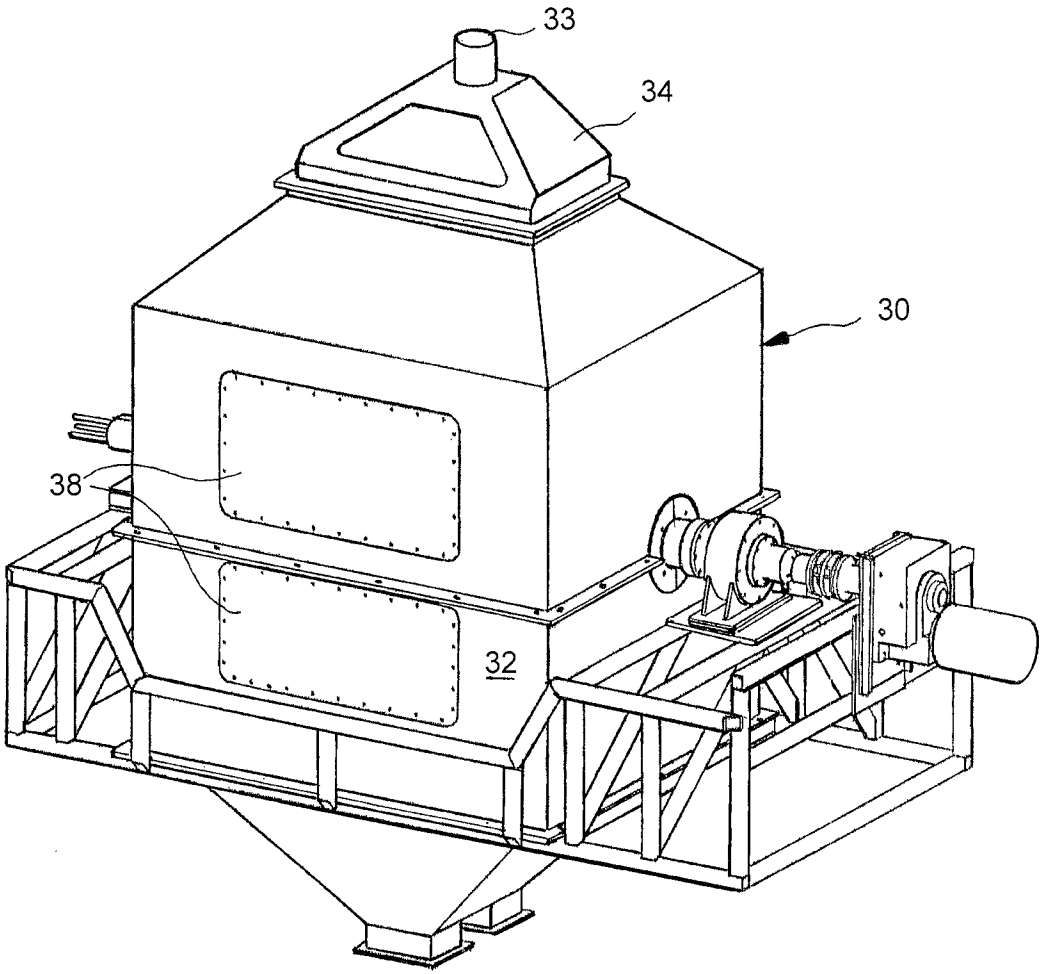
FIG. 4 is a perspective view of the hot magnetic separator of the embodiment.

FIGS. 3 and 4 also illustrate a feed system (i.e., feed connection 33 and feed chute 34) for supplying the particles onto the shell 11. The free end of shaft 23 (the right side in FIG. 2) provides the passage for a nitrogen supply 16 (which will be described later). The temperature at various locations in the system is monitored by, for example, thermocouple wires which extend through the shaft 23. In some embodiments, the feed system is controlled by a control unit, such as a programmed processor, based on the temperature data to control the temperatures of the particles fed by the feed system.

The apparatus also includes a cooling system for maintaining the temperature of the magnets 14 substantially below their Curie point. In particular, the cooling system includes a pair of plates 12 which are disposed between the magnet assembly 22 and the shell 11. The pair of plates 12 are preferably part of a welded metal assembly illustrated in FIG. 5, which, in the embodiment, includes two welded assemblies, each welded assembly comprising a pair of plates defining arcs of approximately 180°. Of course, a single pair of plates, or three or more pairs of plates, could be used, and the arcs defined thereby could vary. The pair of plates 12 in each welded assembly define a gap therebetween, and the sides of the gap are closed by strips of metal which form part of the welded assembly. The cooling system is configured to operate by passing a contained cooling fluid through the gaps between each pair of plates 12. The cooling fluid, preferably a glycol/water mixture, is received via inlet 20 through an extension 20A shown in cutaway. The heated mixture exits via an extension similar to extension 20A, and out through an outlet similar to and in close proximity to inlet 20.

Figure 5:
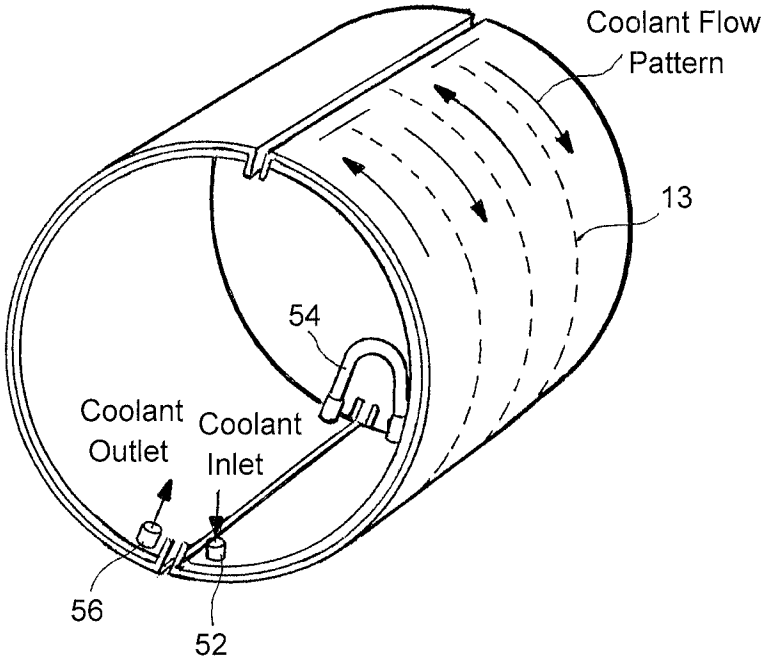
FIG. 5 is a perspective view of the welded assemblies of the cooling apparatus used in the embodiment.

In the embodiment, each inner plate 12 is provided with two openings sized to seal with respective fluid couplings. As illustrated in FIG. 5, on one of the inner plates 12, the first opening is connected to the coolant inlet coupling 52 and the second opening is connected to one end of a transition tube 54. As further illustrated in FIG. 5, on the other of the inner plates 12, the first opening is connected to the other end of the transition tube 54 and the second opening is connected to the coolant outlet coupling 56. The cooling system thus includes a first pair of plates 12 defining a first gap and a second pair of plates 12 defining a second gap, the first gap and the second gap being in serial fluid communication. The welded assemblies defining the cooling system are securely bolted to a bracket attached to the magnet assembly 22.

In the embodiment, one or more barriers 13 are provided within each gap to lengthen the coolant flow path defined within the gap. In other words, the barriers 13 define passages within the welded assembly. Coolant circulated through the passages removes heat emanating from the drum 10.

In the embodiment, the apparatus also includes a supply 16 of inert cooling gas, such as nitrogen, and a conduit 17 for supplying the gas into the magnet assembly 22 for purging the magnet assembly 22 of oxygen. This gas helps remove any heat transferred from the inside of the shell 11 and end plate 15 to the gas spaces inside the drum 10.

As illustrated in FIGS. 3 and 4, the apparatus is defined by a housing 30 having an interior space defining a processing zone which includes the shell 11, the magnet assembly 22, the feed system, and the cooling system. The housing 30 thus maintains the processing zone at an elevated temperature and is substantially filled with the inert gas. The housing is preferably provided with an inner wall 31, an outer wall 32, and an inspection door 38.

The Curie point of permanent magnets can fall within a range of 335 to 370 degrees C. with a working temperature substantially below that point, i.e., in the range of 150 to 200 degrees C. The above-described cooling system is therefore configured to maintain the temperature of the magnet assembly 22 below 120 degrees C.

The apparatus further includes a splitter 41 located below the shell 11 for selectively dividing particles of less magnetic susceptibility from those of greater magnetic susceptibility. The position of the splitter 41 relative to the drum allows it to divide particles of less magnetic susceptibility and particles of greater susceptibility into appropriate chutes 45 for further handling as appropriate via respective material collectors 42, 43. The splitter 41 and chutes 45 are arranged so that material having different levels of attraction to the magnet assembly 22 will land in different respective collectors 42, 43.

The detailed description above describes features and aspects of embodiments of a hot magnetic separator disclosed by way of example. The invention is not limited, however, to the precise embodiments and variations described. Changes, modifications and equivalents can be employed by one skilled in the art without departing from the spirit and scope of the invention as defined in the appended claims. It is expressly intended that all such changes, modifications and equivalents which fall within the scope of the claims are embraced by the claims.

What is claimed is:

1. An apparatus for separating hot particles including a plurality of materials having different magnetic properties, the apparatus comprising:

a plurality of permanent magnets arranged in a magnet assembly and configured to create a magnetic flux capable of providing a coercive force on at least a portion of said particles;

a moving surface proximate said magnet assembly for carrying said particles in a downward path through said magnetic flux while said coercive force attracts said portion of said hot particles toward said moving surface;

a feed system for supplying said particles onto said moving surface; and a cooling system for maintaining the temperature of said magnets substantially below their Curie point, said cooling system comprising a pair of plates which are disposed between said magnet assembly and said moving surface, said cooling system configured to operate by passing a contained cooling fluid through a gap between said pair of plates, wherein at least one barrier is provided within the gap to lengthen a coolant flow path defined within the gap.

2. The apparatus as defined in claim 1 wherein the cooling system further comprises a second pair of plates defining a second gap in serial fluid communication with the gap defined by the pair of plates.

3. The apparatus as defined in claim 1 further including a supply of inert cooling gas and a conduit for supplying said gas into said magnet assembly for purging said magnet assembly of oxygen.

4. The apparatus as defined in claim 1 further including a housing having an interior space defining a processing zone which includes said moving surface, said magnet assembly, said feed system, and said cooling system, said housing enclosing said processing zone for maintaining said processing zone at an elevated temperature and substantially filled with said inert gas.

5. The apparatus as defined in claim 1 wherein said cooling system maintains the temperature of said magnets below 120 degrees C.

6. The apparatus as defined in claim 1 further including a control system for controlling the temperature of said particles supplied by said feed system.

7. The apparatus as defined in claim 6 wherein the control system controls the feed system based on one or more monitored temperatures of the apparatus.

8. The apparatus as defined in claim 1 further including a splitter below said moving surface for selectively dividing particles of less magnetic strength from those of greater magnetic strength.

9. The apparatus as defined in claim 1 wherein said moving surface moves in a curved path.

* * * * *